US005080595A

United States Patent [19]

Mouissie

[11] Patent Number: 5,080,595

[45] Date of Patent: Jan. 14, 1992

[54] HYBRID CONNECTOR HAVING CONTACT ELEMENTS IN THE FORM OF FLEXIBLE CONDUCTOR FILM

[75] Inventor: Bob Mouissie, EK Berlicum, Netherlands

[73] Assignee: E. I. du Pont de Nemours and Company, Wilmington, Del.

[21] Appl. No.: 640,452

[22] Filed: Jan. 11, 1991

[30] Foreign Application Priority Data

Jan. 12, 1990 [NL] Netherlands ..... 9000087

[51] Int. Cl.[5] ..... H01R 13/66

[52] U.S. Cl. ..... 439/67; 333/185; 439/620

[58] Field of Search ..... 439/67, 77, 76, 59, 439/65, 620; 333/182, 183, 185

[56] References Cited

U.S. PATENT DOCUMENTS

| | | | |
|---|---|---|---|
| 4,227,767 | 10/1980 | Mouissie | 439/493 |
| 4,348,071 | 9/1982 | Hsieh | 439/67 |
| 4,379,608 | 4/1983 | Olsson et al. | 439/67 |
| 4,726,790 | 2/1988 | Hadjis | 439/620 |
| 4,959,626 | 9/1990 | Mouissie | 333/182 |

FOREIGN PATENT DOCUMENTS

| | | |
|---|---|---|
| 0073600 | 4/1983 | European Pat. Off. . |
| 0332280 | 5/1989 | European Pat. Off. . |
| 2086151 | 11/1982 | United Kingdom . |

*Primary Examiner*—Neil Abrams

[57] ABSTRACT

A hybrid connector, comprising a housing having a contact side for making contact to a further connector, a connection side for connecting an electrical wiring and a flat substrate which is situated on the connection side of the connector. This substrate is provided with a plurality of hybrid circuit components, having connecting electrode patches. The contact elements of the connector are formed by parallel, electrically conducting contact tracks on a flexible film, which film extends over a supporting body from the contact side to the connection side of the connector. Assemblies of spring strips being provided, supported by the supporting body, for exerting a force on the film, such that its contact tracks make electrical contact to the corresponding contact electrodes or wiring electrodes of the further connector, the electrical wiring and the flat hybrid substrate. By using a special support frame for the substrate, a solder-free connector is provided.

13 Claims, 2 Drawing Sheets

HYBRID CONNECTOR HAVING CONTACT ELEMENTS IN THE FORM OF FLEXIBLE CONDUCTOR FILM

BACKGROUND OF THE INVENTION

This invention relates to a connector comprising a substrate having a plurality of hybrid electrical circuits, such as LC-filter circuits. The invention relates also to a hybrid substrate for use in such a connector.

A hybrid connector generally comprises a housing having a contact side for making contact to the contact electrodes of a further connector and a connection side for connecting the wiring electrodes of an electrical wiring, such as the wiring tracks on a printed circuit board (PCB). Said housing accommodates a plurality of contact elements or terminals of electrically conducting material extending between said contact and wiring side, supported by an elongated supporting body situated in the housing. At the connection side of the connector a hybrid substrate is provided, having a plurality of hybrid circuits, each comprising a first and second connection electrode, of which the first connection electrode is connected to a contact element of the connector. The second connection electrode generally connects to the signal ground of an electrical device using said connector.

A connector having a hybrid substrate comprising capacitive filter circuits is known, inter alia, from U.S. Pat. No. 4,959,626.

In an embodiment of this U.S. patent, the contact elements are shaped as contact pins which extend from the contact side to the connection side of the connector and provide both on the contact side and the connection side the electrical contact to, respectively, a further connector to be contacted and an electrical wiring to be connected. The filter substrate is provided with through holes in which the contact pins project in their assembled state. Said contact pins and filter circuits i.e. their first connection electrodes, are electrically connected by soldering. It is this manner of connecting the filter circuits and the contact elements of the connector which provides a number of disadvantages.

Solder contacts are per se fairly hard to work and consequently expensive. Account also must be taken of undesirable connections of connection electrodes of the filter components due to the soldering process, unreliable electrical connections as a consequence of contaminants and gas bubbles in the solder joint, etc.

Furthermore, the use of contact pins in combination with a flat hybrid substrate requires the provision of relatively large through holes in the substrate as a consequence of tolerances in the dimensions thereof. In ceramic hybrid substrates used in practice, tolerances in the dimensions of approximately $\pm 1\%$ are normal. With a substrate length of, for example, 100 mm, this may lead to a positional tolerance of the through holes of approximately 1 mm. Accordingly, the through holes should then essentially have a cross-sectional size of the pin thickness plus 2 mm. These relatively large holes constitute a lower limit for the pitch distance between the contact elements of the connector, and the area available for the hybrid circuit components on the substrate is limited thereby. In the case of connectors having a large contact element density, the relatively large through holes also have a disadvantageous effect on the mechanical strength and consequently the maximum usable length of the hybrid substrate.

SUMMARY OF THE INVENTION

The present invention therefore has as one of its objects providing a hybrid connector in which the above-mentioned disadvantages of the prior art are overcome.

This is accomplished in that the first connection electrodes of the hybrid circuits are designed as connection patches of electrically conducting material for surface contacting accessible from a surface of the hybrid substrate, the contact elements comprising parallel, electrically conducting contact tracks provided on a surface of a flexible film or foil of electrically insulating material, which film extends over the supporting body, with its other surface facing the latter, from the contact side to the connection side, and there being provided at the contact side and connection side, between the film and the supporting body, assemblies of spring strips supported by the supporting body for exerting a force on the film for the contact tracks to make contact to respective contact electrodes and connection electrodes of the further connector, the electrical wiring and the hybrid substrate.

In the connector according to the invention, the link between the contact side and the connection side with the aid of contact elements such as contact pins has been replaced by a flexible film provided with electrically conducting contact tracks. Said contact tracks are pressed with the aid of the spring elements against the respective first connection electrodes of the hybrid substrate in a manner such that a surface contacting is obtained between the respective contact tracks and the connection electrodes. The contact tracks are also advantageously used to make surface contact both to a further connector at the contact side and to the electrical wiring at the connection side of the connector, and this yields an appreciable simplification of the construction of the connector.

As a result of this surface contact, the need for soldering has been eliminated. The hybrid substrate no longer needs to be provided with through holes for contact pins which promotes the mechanical ruggedness of the hybrid substrate. Furthermore, the surface contacting of the invention is less prone to tolerance differences than the prior art pin-hole connections.

In the connector according to the invention no loss of substrate area for forming circuit components arises as a consequence of providing through holes. Accordingly, a smaller substrate area can be sufficient to achieve, for example, one and the same filter action as with a filter substrate according to the prior art. This is capable of resulting in a filter substrate of smaller dimensions or in a higher filter component density, as a result of which the pitch distance between the contact elements of the connector can be reduced. This last aspect is of importance in connection with the drive for as high a contact element density as possible in connectors. On the other hand, in the connector according to the invention there is a larger substrate area available for providing larger circuit components, such as capacitors. This is capable of resulting in a filter substrate of the same dimensions but having an increased filter action, compared to the prior art.

The use of flexible film, foil or flat cable having contact tracks in connectors is per se known and inter alia described in U.S. Pat. Nos. 4,227,767; 4,348,071 and 4,379,608. However, the embodiments disclosed by said patents are not capable of, nor suggest, contacting a further connector, an electrical wiring on a PCB and a hybrid circuit substrate by one and the same flexible film.

In a further embodiment of the connector according to the invention, the assembly of spring strips at the wiring side of the connector is arranged in a manner such that spring strips extend in two or more planes. By arranging spring strips in planes which are transverse to one another, it is possible, for example, to contact a plurality of hybrid substrates at the connection side of the connector. In, for example, filter components comprising interference suppression capacitors, the effective capacitance value can be increased simply by making parallel contact to a plurality of filter components of different substrates. The arrangement of spring strips in a plurality of planes also offers the possibility of making contact to wiring tracks of a plurality of printed circuit boards.

Although a separate spring element may be used, for example, for each contact track or each contact with an electrode of a hybrid substrate or a printed circuit board, it is advantageous, for the purpose of simplifying the connector construction, to combine the spring elements into one or several assemblies. To this end, in a yet further embodiment of the connector according to the invention, the assemblies of spring strips at the connection side are formed as a single entity comprising an elongated U-shaped support, at two or more sides of which adjacently situated spring strips formed as self-supporting fingers extend in the direction away from the support. With the same object, the assemblies of spring strips at the contact side comprise an elongated support rail from which adjacently situated, parallel spring strips extend, each provided with a semicircular bulge near the centre thereof and pointing in the direction of the film. Said semicircular bulge has, inter alia, the object of securing a plugged-on further connector in a tightly clamping manner.

A rapid and relatively simple assembly of the connector according to the invention is achieved in one embodiment in a manner such that the supporting body is provided with projecting positioning pins for positioning the assemblies of spring strips, which are provided, for this purpose, with correspondingly situated positioning holes. With the same object, the flexible film and the hybrid substrate are also provided, in another embodiment of the connector according to the invention, with positioning holes situated so as to mate with the respective positioning pins. In yet another embodiment is the film also provided, at its ends where the contact tracks terminate, with holes whose position corresponds to pins on the supporting body at the contact side of the connector, for the overlapping locking of the said ends of the film.

Owing to the absence of solder connections between the hybrid circuit components and the contact elements it is necessary to provide means for mechanically fixing the hybrid substrate in the connector. In an embodiment of the connector according to the invention in which the substrate is elongated in shape, the second connection electrode of one or more hybrid components being of shared construction and it being possible to make contact electrically at at least one long edge of the substrate, an elongated supporting frame of electrically conducting material being provided for mounting the hybrid substrate at the connection side of the connector, which supporting frame is provided with locking means for locking the hybrid substrate to the supporting body in a manner such that the contact tracks of the flexible film make electrical contact with the corresponding firsts connection electrodes of the hybrid substrate.

Besides achieving a mechanically rigid attachment, the electrical contact with the second (shared) connection electrode of the hybrid circuit components can also be brought about with the supporting frame. For this purpose, the hybrid substrate may be secured to the supporting frame by soldering. That is to say, the long edges of the hybrid substrate are connected to the supporting frame in a manner such that the positioning holes are accurately aligned with the respective positioning pins of the supporting body at the connection side of the connector. Preferably, the supporting frame is provided with receiving grooves at its long edges for receiving the long edges of the hybrid substrate. A simple alignment is then achieved if the supporting frame is provided with positioning holes situated so as to mate with the hybrid substrate. In order to prevent, as far as possible, undesirable mechanical stresses in the substrate, it is advisable to manufacture the supporting frame of a material which has the same, or virtually the same, linear coefficient of thermal expansion as the hybrid substrate.

For the completely solder-free assembly of a hybrid substrate, the supporting frame is provided, in a further embodiment of the connector according to the invention, at its long edges, with receiving grooves for receiving the long edges of the hybrid substrate, wherein spring lips projecting into the receiving grooves for making electrical contact to the second connection electrode of the hybrid circuit components. In this case, matching of coefficients of thermal expansion is not necessary.

To connect the (shared) second connection electrode of the hybrid circuit components to, for example, the signal earth of an electrical circuit at the connection side of the connector, in another embodiment the supporting frame is provided with further spring lips projecting in the direction away from the frame for making electrical contact to an external body. The further spring lips preferably project from the receiving grooves in the direction transverse to the plane of the supporting frame for connection to a printed circuit board by means of surface contacting.

In the preferred embodiment of the connector according to the invention having, for example, 80 or more contact positions, the hybrid substrate is provided with two composite rows of hybrid circuit components having first connection electrodes adjacently situated in one row, the supporting body being of U-shaped construction at the contact side, for making, from the open side thereof, contact with a further connector, spring strips being situated at each side of a leg of the supporting body, the flexible film being provided with two composite rows of contact tracks in a manner such that the contact tracks of one row extend from one row of hybrid circuit components from the connection side over a leg of the supporting body to the contact side and the contact tracks of the other row extending from the other row of hybrid circuit components from the connection side over the other leg of the supporting body to the contact side, the adjacently situated contact strips of one row terminating in an alternating manner at the one or the other side of a leg of the U-shaped supporting body.

As already mentioned, the spring strips may extend at the wiring side of the connector in a plurality of planes for the purpose of making contact to the hybrid substrate and, for example, one or more printed circuit boards. In an embodiment of the connector according to the invention which is advantageous for assembling printed circuit boards the housing is provided, at the connection side, with lips situated in the longitudinal direction parallel to, and at a distance from the supporting body for receiving, between such a lip and a plane of spring strips situated parallel thereto, a printed circuit board such that the contact tracks of the flexible film make contact, under the influence of the spring strips, with the corresponding wiring electrodes on the printed circuit board.

The invention also relates to a hybrid substrate suitable for use in a connector according to one or more of the preceding embodiments, comprising an elongated flat substrate of electrically insulating material provided with electrical circuits having a first and second connection electrode, the first connection electrode being constructed as connection patch of electrically conducting material, accessible from a surface of the substrate for making surface contact, and the second electrode of one or more circuits being constructed as a shared connection electrode to be electrically contacted near a long edge of the substrate.

The embodiment of said hybrid substrate for use in the preferred embodiment of the connector according to the invention has a substrate which is provided with two composite rows of circuits, components, the first connection electrodes comprising two rows of adjacently situated connection patches, the mutual distance between the connection patches in a row being half the pitch distance of the contact tracks in a row of contact tracks of the flexible film.

The preferred embodiment of the connector according to the invention using a filter hybrid and printed circuit boards is explained below with reference to the drawings.

DETAILED DESCRIPTION OF THE PREFERRED EMBODIMENT

Figures 1, 4, 5:
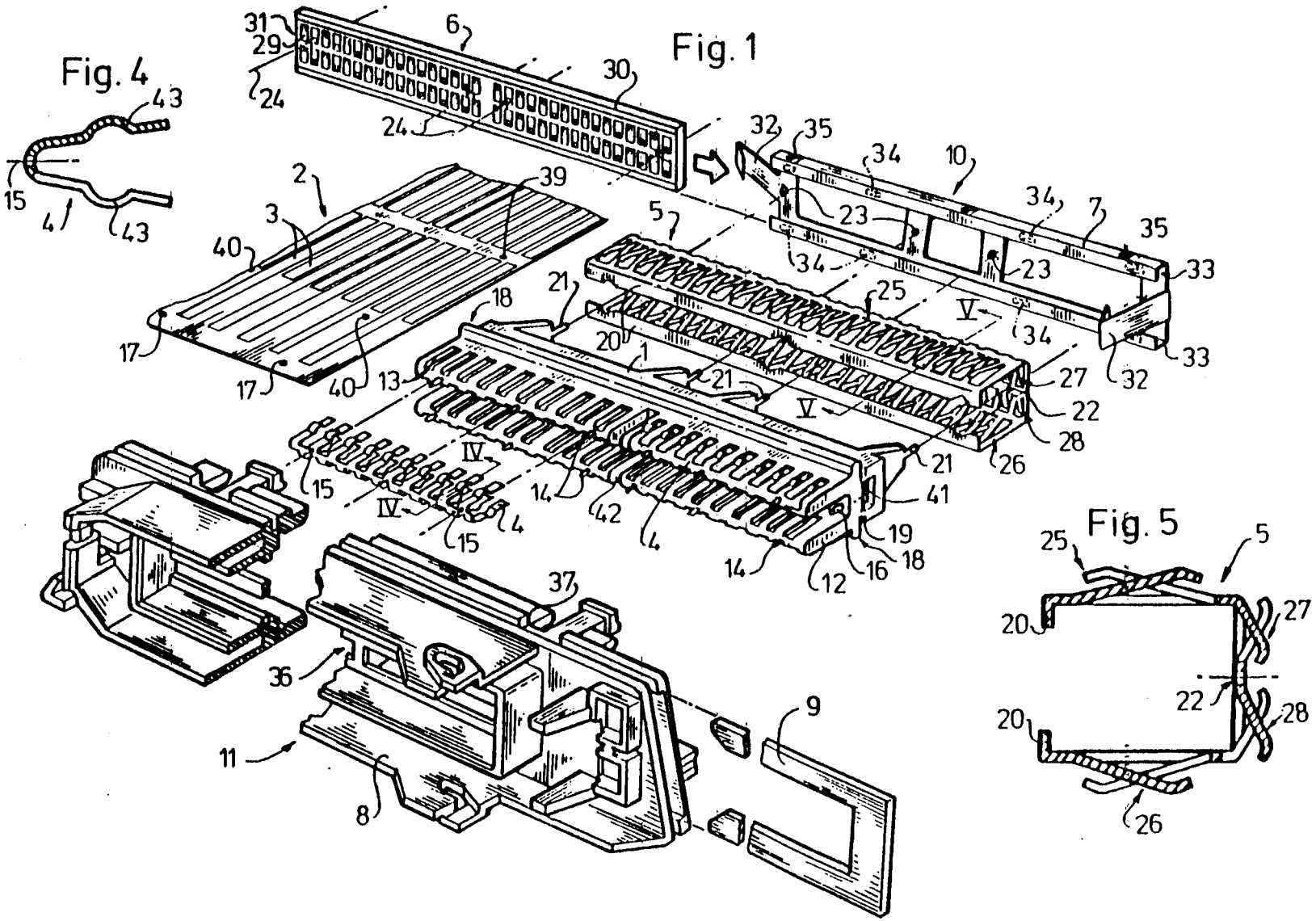
FIG. 1 shows diagrammatically, in perspective, the preferred embodiment, in exploded view, of the connector according to the invention having a flat filter unit, a few parts being truncated for the purpose of the clarity of the figure.
FIGS. 4 and 5 show diagrammatically a cross section of the assemblies of spring strips of the connector according to FIG. 1, along the lines IV—IV and V—V, respectively, on a different scale.

FIG. 1 shows diagrammatically, in perspective, the preferred embodiment of the connector according to the invention in exploded view. The connector comprises an elongated supporting body 1, a flexible film or foil 2 which is provided with parallel electrically conducting contact tracks 3 on one side, assemblies of spring strips 4, 5, a flat filter unit 6, a supporting frame 7 for the filter unit 6, a housing 8 and a locking slider 9 for locking the supporting body 1 in the housing 8. The connector has a connection side 10 for connecting an electrical wiring and a contact side 11 for making contact to a further connector. In the assembled state, the supporting body 1 carries, at the contact side 11, one or more assemblies of spring strips 4 and the housing 8 and, at the wiring side 10, the assembly of spring strips 5 and the supporting frame 7 with the filter unit 6, together with the film 2 which encircles the whole.

The supporting body 1, which may be manufactured, for example, from plastic but also from metal, has supporting edges 12 for plugging-on a further connector (not shown) at the contact side. In the assembled state, said supporting edges 12 carry the assemblies of spring strips 4 for receiving a further connector in a clamping manner and for pressing the contact tracks 3 of the film 2 against the corresponding contact elements of said further connector. Provided in the supporting edges 12 are recesses 13, transverse to the longitudinal direction thereof, for receiving separate spring strips of the assemblies of spring strips 4. Furthermore, the supporting edges 12 are provided with positioning pins 14 which project from the supporting body on the contact side 11. The position of the positioning pins 14 corresponds to the positioning holes 15 in the assemblies of spring strips 4 and to positioning holes 40 in the film 2, to ensure the correct mutual position of said spring strips 4, the film 2 and the supporting body 1. At the contact side 11, the supporting body 1 is provided with locking pins 16 between the supporting edges 12 for positioning and locking the film 2. For this purpose, the film is provided with locking holes 17 at the edges where the contact tracks 3 terminate, which edges overlap each other in the assembled state in a manner such that a locking pin 16 always projects through two locking holes 17 situated opposite each other. In order to avoid undesirable electrical connections between the contact tracks 3 situated opposite one another, these terminate at a distance from the respective edges of the film 2. The supporting body 1 is furthermore provided with two upright edges 18 for locking the supporting body 1 in the housing 8 by means of the locking slider 9.

At the connection side 10, the supporting body 1 is designed to support the assembly of spring strips 5. For this purpose grooves 19 are provided in the supporting body 1, parallel to the upright edges, for receiving edges 20 of the assembly of spring strips 5. Furthermore, the supporting body 1 is provided, at the connection side 10, with positioning pins 21 whose position respectively corresponds to positioning holes 22 in the assembly of spring strips 5, positioning holes 39 in the film 2, positioning holes 23 in the supporting frame 7 and positioning holes 24 in the flat filter unit 6, all this in order to fix the position of the assembly of spring strips 5, the film 2, the supporting frame 7 and the flat filter unit 6 mutually and with respect to the supporting body 1.

The assembly of spring strips 5 comprises a U-shaped support having assemblies 25 and 26, situated at the oppositely situated sides thereof, of self-supporting spring strips which serve to firmly clamp printed circuit boards (not shown in this figure) and to press the contact tracks 3 of the film 2 against the respective contact patches of said printing circuit boards. At its intermediately situated side, the U-shaped support of the assembly of spring strips 5 comprises assemblies 27 and 28 of self-supporting spring strips for the purpose of pressing the conducting tracks 3 of the film 2 against connection patches 29 of the flat filter unit 6. The U-shaped support of the assembly of spring strips 5 is manufactured from metal.

The flat filter unit 6 comprises, in general, a substrate of ceramic material on a face of which a plurality of mutually separated connection patches 29 are provided for surface contacting by the respective contact tracks 3 of the film 2. Said connection patches 29 also form one electrode of an equal number of capacitors, the other electrode of which is of shared construction for a plurality of, or all of, the capacitors. Provided between the connection patches 29 and the shared electrode(s) 30 is a suitable dielectric. The shared electrode(s) 30 may be contacted at one or more edges of the substrate for connecting it, for example, to the signal earth of an electrical circuit. In the embodiment as shown, the filter unit 6 comprises two composite rows 31 of connection patches 29, the number of which corresponds to the number of contact tracks 3 on the film 2. Instead of capacitors, use may also be made of a filter hybrid comprising (R)LC filter components provided in a similar manner with connection patches 29 for surface contacting by the contact tracks 3 of the film 2. For the purpose of illustration, the contact point of the respective spring strip of the assemblies 27, 28 is indicated with a small circle in each connection patch 29.

The flat filter unit 6 is attached to the supporting body 1 with the aid of the elongated supporting frame 7. For this purpose, the supporting frame 7 is provided, at the narrow sides, with hook-like locking means 32 which, in the assembled state, engage in recesses 41 provided at the narrow sides of the supporting body 1. The supporting frame 7, which is manufactured from electrically conducting material, is provided, at the long edges, with grooves 33 for receiving the filter unit 6 and makes contact with the shared electrode(s) 30 of the filter unit 6. The hook-like locking means 32 are designed in a manner such that they can be bent out far enough to fit the filter unit 6 in the supporting frame 7, as illustrated by an arrow in FIG. 1.

In order to obtain a rigid whole, the long sides of the filter unit 6 are secured by soldering, preferably positioned in the supporting frame 7, the positioning holes 24 of the filter unit 6 being aligned on the positioning holes 23 of the supporting frame 7. The linear coefficients of thermal expansion of the supporting frame 7 and the filter unit 6 are preferably as equal as possible to each other. As an alternative, the filter unit 6 may be mounted in a spring manner in the supporting frame 7. For this purpose, the supporting frame 7 may be provided with spring lips 34 projecting into the grooves 33, which spring lips are indicated with broken lines in FIG. 1. Said lips 34 are preferably formed from the material of the supporting frame 7 itself. Soldering of the filter unit 6 in the supporting frame 7 is not necessary in this case. The difference in thermal expansion of the filter unit 6 and the supporting frame 7 can effectively be absorbed with the said spring lips 34.

For connecting the shared electrode(s) 30 of the filter unit 6 to the signal earth of an electrical circuit, the supporting frame 7 is provided, at the grooves 33, with outwardly projecting further spring lips 35 as shown. Said further spring lips 35 are themselves also preferably formed from the material of the supporting frame 7.

The housing 8 is provided with cruciformly arranged reinforcing ribs 36 in the hole for the supporting body 1, on the one hand, to reinforce the housing and, on the other hand, to lock the ends of the film 2 on the locking pins 16. The supporting body has, at the contact side 11, a recess 42 for receiving the transversely running reinforcing rib 36.

Figure 2:
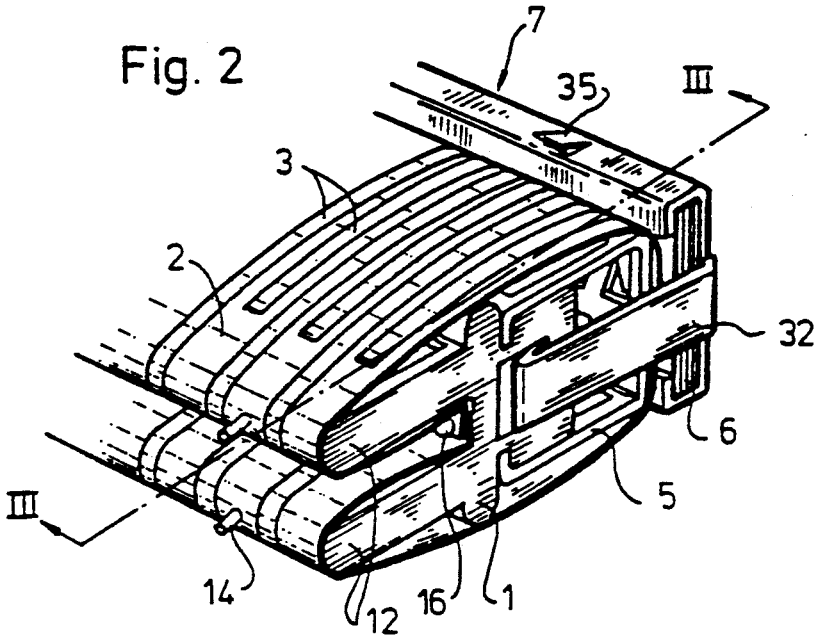
FIG. 2 shows diagrammatically, in perspective, the assembled connector according to FIG. 1, however without its housing and on a different scale.

FIG. 2 shows the manner in which the film 2 lies on the supporting body 1 with the assemblies of spring strips 4 and 5 before the housing 8 is fitted. The contact tracks 3 of the film 2 extend symmetrically from the wiring pads 29 of the filter unit 6 to the supporting edges 12 of the supporting body 1. Here the long or short contact tracks 3 terminate alternately at the one or the other side respectively of the supporting edge 12.

The assemblies of spring strips 4 at the contact side 11 of the connector are constructed from an elongated support rail from which adjacently situated parallel spring strips extend. The assemblies of spring strips 4 are constructed such that the spring strips are situated in an offset manner at the one side of a supporting edge 12 with respect to the other side of the same supporting edge 12, the offset being half the distance between neighbouring spring strips. The recesses 13 in the supporting edges 12 are of course situated correspondingly. In order to promote electrical contact between the contact elements of a further connector and the conducting contact tracks 3 of the film 2, the spring strips, as shown in detail in FIG. 4, are each provided near the middle with a semicircular bulge 43.

FIG. 5 shows a section through the assembly of spring strips 5. The spring strips, formed as self-supporting spring fingers, of each assembly 25, 26, 27 and 28 respectively, extend in an alternating manner from oppositely situated edges of a face of a U-shaped support. The spring strips 27, 28 are arranged in parallel for making contact with the two composite rows 31 of connection patches 29 of the flat filter unit 6.

Figure 3:
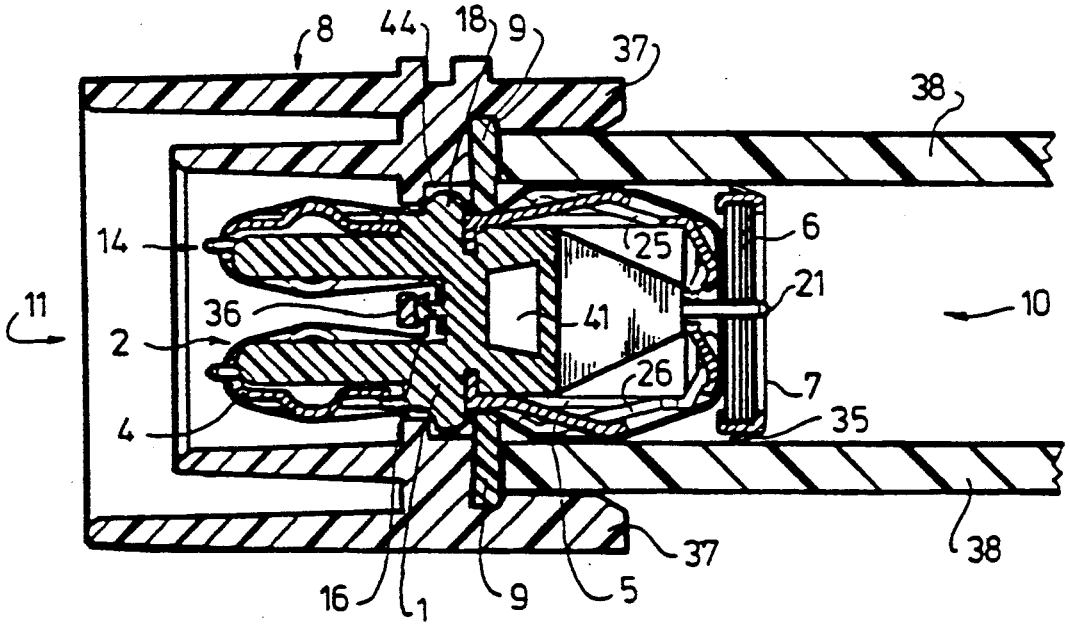
FIG. 3 shows diagrammatically a cross section of the assembled connector of FIG. 1 along the line III—III on a different scale and with printed circuit boards mounted.

FIG. 3 shows a cross section of the connector according to the preferred embodiment of the invention in the assembled state. To clamp the printed circuit boards 38, the housing 8 is provided, at the connection side 10, with parallel lips 37 which are situated opposite each other and extend in the longitudinal direction of the housing 8. The two printed circuit boards 38 are clamped between the lips 37 and the film 2 supported by the respective spring strips 25, 26 of the assembly of spring strips 5, the contact tracks of the film 2 pressing against contact surfaces (not shown) of the boards 38. The positioning pins 14 and 21 project, respectively, through the positioning holes 40 and 39 in the film 2 in order to fix the latter with respect to the other connector parts. The lips 35 of the supporting frame 7 make contact to the two printed circuit boards 38 for the purpose of connecting the shared electrode(s) 30 of the filter unit 6 with the signal earth or ground.

In order to prevent moisture reaching the electrical circuits at the wiring side 10 from the contact side 11 of the connector, a silicone-based seal may be fitted in the space 44 present between the upright edges 18 of the supporting body 1 and the housing 8.

On the basis of the inventive idea underlying the present invention, many modifications and additions to the preferred embodiment of the connector shown are possible for a person skilled in the art. For example, the supporting body 1 may be provided with only one supporting edge 12 and only one printed circuit board 38 may be fitted at the connection side 10 of the connector, as a result of which, if necessary, a section of the assembly of spring strips 5 can be omitted, for example the spring strips 25 or the spring strips 26. The positions of the printed circuit boards 38 and the flat filter unit 6 may essentially be interchanged, or a plurality of filter units 6 or other hybrid circuits may be fitted instead.

I claim:

1. A hybrid connector, comprising a housing having a contact side for making contact to a further connector and a connection side for connecting an electrical wiring, a plurality of contact elements of electrically conducting material extend between said contact and wiring side supported by an elongated supporting body situated in the housing, at the connection side of the connector a hybrid substrate is provided, having a plurality of hybrid circuits, each comprising a first and a second connection electrode, of which the first connection electrode is connected to a contact element of the connector, wherein the first connection electrodes of the hybrid circuits are constructed as connection patches of electrically conducting material for surface contacting, accessible from a surface of the hybrid substrate, the contact elements comprising parallel, electrically conducting contact tracks provided on a surface of a flexible film of electrically insulating material, which film extends over the supporting body, with its other surface facing the latter, from the contact side to the connection side, and there being provided at the contact side and connection side, between the film and the supporting body, assemblies of spring strips supported by the supporting body for exerting a force on the film for the contact tracks to make contact to respective contact elements of the first connection electrode of the further connector, the electrical wiring and the hybrid substrate.

2. A connector according to claim 1, wherein the assemblies of spring strips at the connection side of the connector are arranged in a manner such that spring strips extend in two or more planes.

3. A connector according to claim 2, wherein the assemblies of spring strips at the connection side are formed as a single entity comprising an elongated U-shaped support, at two or more sides of which adjacently situated spring strips formed as self-supporting fingers extend in the direction away from the support.

4. A connector according to claim 1, wherein the assemblies of spring strips at the contact side comprise an elongated support rail from which adjacently situated, parallel spring strips extend, each provided with a semicircular bulge near the middle and pointing in the direction of the film.

5. A connector according to claim 4, wherein the supporting body is provided, at the contact side, with recesses, situated transversely to the longitudinal direction thereof, for receiving the spring strips.

6. A connector according to claim 1, wherein the supporting body is provided with projecting positioning pins for positioning the assemblies of spring strips which are provided, for this purpose, with positioning holes situated so as to mate with the positioning pins.

7. A connector according to claim 6, wherein the flexible film and the hybrid substrate are provided with positioning holes situated so as to mate with the respective positioning pins.

8. A connector according to claim 1, wherein the film is provided at its ends where the contact tracks terminate, with holes whose position mate with pins provided on the supporting body at the contact side of the connector, for the overlapping locking of the said ends of the film.

9. A connector according to claim 1, wherein the hybrid substrate is elongated in shape, the second connection electrode of one or more hybrid circuit components being of shared construction and it being possible to make electrical contact at at least one long edge of the substrate, an elongated supporting frame of electrically conducting material being provided for mounting the hybrid substrate at the connection side of the connector, which supporting frame is provided with locking means for locking the hybrid substrate to the supporting body in a manner such that the contact tracks of the flexible film make electrical contact with the corresponding first connection electrodes of the hybrid substrate.

10. A connector according to claim 9, wherein the supporting frame is provided at its long edges with receiving grooves for receiving the long edges of the hybrid substrate, spring lips projecting into the receiving grooves being provided for making electrical contact with the second connection electrode of the hybrid circuits.

11. A connector according to claim 10, wherein the supporting frame is provided with further spring lips projecting in the direction away from the frame for making electrical contact to the external body.

12. A connector according to claim 1, wherein the hybrid substrate is provided with two composite rows of hybrid circuits having first connection electrodes situated adjacently in a row, the supporting body being of U-shaped construction at the contact side for making, from the open side thereof, contact with the further connector, spring strips being situated on each side of a leg of the supporting body, the flexible film being provided with two composite rows of contact tracks in a manner such that the contact tracks of one row extend from one row of hybrid circuit components from the connection side over a leg of the supporting body to the contact side and the contact tracks of the other row extending from the other row of hybrid circuit components from the connection side over the other leg of the supporting body to the contact side, the adjacently situated contact strips of one row terminating in an alternating manner at the one or the other side of a leg of the U-shaped supporting body.

13. A connector according to claim 12, wherein the housing is provided at the connection side with lips situated in the longitudinal direction parallel to, and at a distance from, the supporting body for receiving, between such a lip and a plane of spring strips parallel thereto, a printed circuit board such that the contact tracks of the flexible film make contact, under the influence of the spring strips, with the respective wiring electrodes on the printed circuit board.

* * * * *